United States Patent [19]

Möhring

[11] 4,343,003

[45] Aug. 3, 1982

[54] DIRECTIONAL ANTENNA FOR MICROWAVE TRANSMISSIONS

[75] Inventor: Günter Möhring, Langenhagen, Fed. Rep. of Germany

[73] Assignee: Kabel-und Metallwerke Gutehoffnungshutte Aktiengesellschaft, Hanover, Fed. Rep. of Germany

[21] Appl. No.: 160,431

[22] Filed: Jun. 17, 1980

[30] Foreign Application Priority Data

Sep. 29, 1979 [DE] Fed. Rep. of Germany ..... 2939697

[51] Int. Cl.[3] ..... H01Q 19/19

[52] U.S. Cl. ..... 343/781 P; 343/840

[58] Field of Search ..... 343/840, 772; 343/781 R, 781 P, 781 CA

[56] References Cited

U.S. PATENT DOCUMENTS

| | | | |
|---|---|---|---|
| 2,531,454 | 11/1950 | Marshall | 343/781 P |
| 2,597,391 | 5/1952 | Sichak | 343/781 R |
| 2,679,003 | 5/1954 | Dyke et al. | 343/781 R |
| 3,445,852 | 5/1969 | Karlson | 343/772 |
| 3,553,707 | 1/1971 | Yang et al. | 343/781 R |
| 3,623,115 | 11/1971 | Schuttloffel et al. | 343/840 |

FOREIGN PATENT DOCUMENTS

| | | | |
|---|---|---|---|
| 1128952 | 1/1957 | France | 343/781 R |

*Primary Examiner*—Eli Lieberman
*Attorney, Agent, or Firm*—Martin A. Farber

[57] ABSTRACT

An improved directional antenna for microwave transmissions is disclosed comprising a paraboloidal main reflector, a waveguide feed having a first open end thereof positioned on the axis of the main reflector, and a second waveguide of the same size serially connected between the second open end of the waveguide feed and a transmission device such as a microwave transceiver. The waveguide feed has an elliptical cross-section throughout its axial length, thus providing an elliptically shaped first open end that in of itself and without separate horn attachment, functions as a feed energizer; while the second waveguide also has an elliptical cross-section of the same size, which in combination with such waveguide feed provides a microwave coupling to the transmission device that minimizes reflections, respectively matching problems, especially in the case of overmoded waveguide applications.

5 Claims, 2 Drawing Figures

FIG. 1
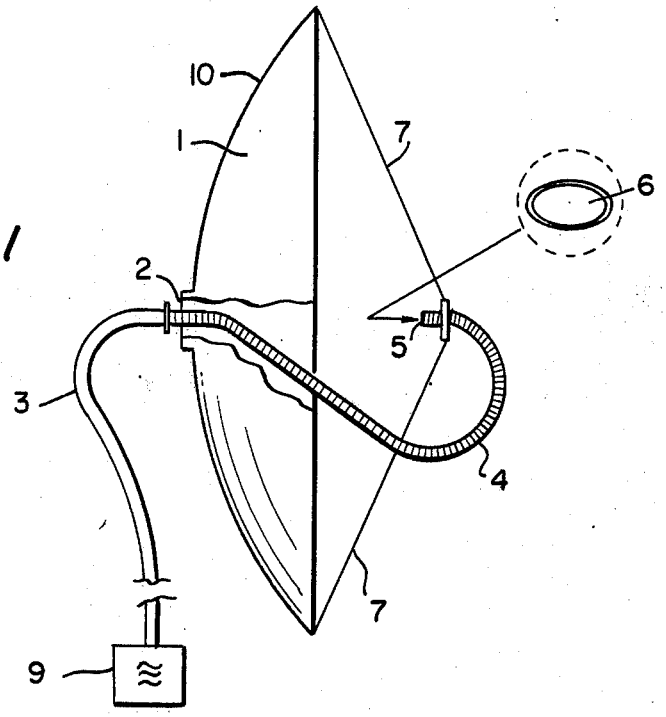
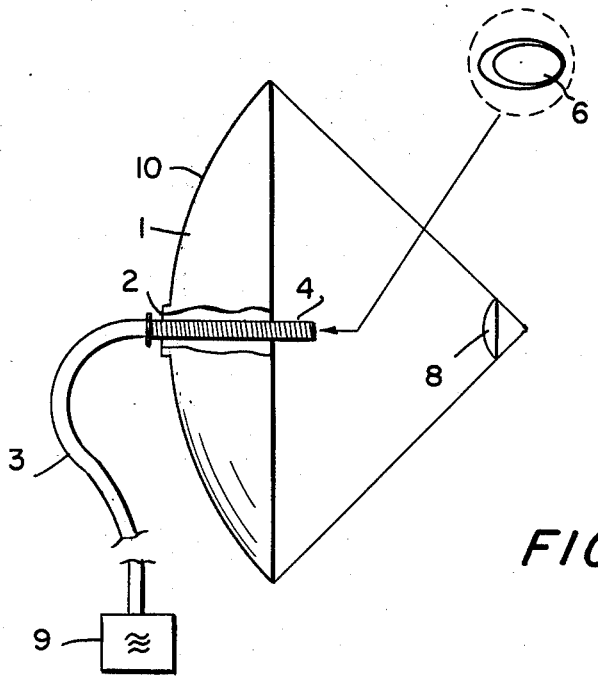
FIG. 2

DIRECTIONAL ANTENNA FOR MICROWAVE TRANSMISSIONS

The present invention relates to a directional antenna for microwave transmissions, and particularly to such antennas comprising a conventional paraboloidal reflector, and a waveguide feed which is comprised of a hollow tubular conductor of elliptical cross-section.

As is known, highly directional antenna systems comprising conventional paraboloidal reflectors have been suggested for use in the microwave field for point-to-point terrestrial transmissions, as well as for ground to satellite transmissions. Notwithstanding their particular mode of operation (i.e., whether with or without subreflector components), the design objectives of such prior antenna systems have included, inter alia, attempts to achieve high reflector efficiencies for increased transmission distances. Generally, in the effort to realize such efficiencies, the priorly known directional antennas have been provided with separate structural energizer horns of precise dimensions and orientations so as to selectively direct particular radiations in a predetermined manner. Though the cross-sectional configurations of the waveguides of such priorly known directional antennas have varied, e.g., square, rectangular or circular, separate energizer horns have been necessary in all significant prior art types to achieve adequate, directional illumination of the main reflectors thereof. Such separate energizer horns have been employed in the priorly known directional antennas to avoid or substantially mitigate microwave transmissions with regard to predetermined directions to or from the main reflector, thus suppressing scattering of undesired transmissions. Despite such prior art employment of such energizer horns, a high degree of reflector efficiencies were often not sufficiently achieved.

It is an object of the instant invention to provide a directional antenna which is simpler in construction than those priorly known, and which provides improved side lobe attenuation, improved reflection characteristics and gain due to superior main reflector illumination.

The aforesaid object of the invention is obtained by the provision of a directional antenna comprising a paraboloidal main reflector and a waveguide feed having a first open end thereof positioned on the axis of the main reflector, such open end having an elliptical configuration which in of itself functions as the feed energizer. As no separate structural attachment is required to function as the energizer horn, the directional antenna of the instant invention provides economies of manufacture.

The elliptical configuration of the first open end of the waveguide feed may be readily adjusted and aligned with respect to the main reflector, thus permitting improved pattern characteristics in the E plane as well as in the H plane of the directional antenna. Furthermore, as the directional antenna of the instant invention employs in serial combination a waveguide feed and a second waveguide connected between a transmission device such as a transceiver, and the feed energizer position on the axis of the main reflector, no additional transition elements are required. Such transition elements are generally required in the prior art directional antennas in those circumstances wherein the cross-section of the energizer horn and the waveguide differ, or the cross-section of the waveguide differs along its axial length, or the waveguide makes drastic changes in direction along its axial length.

As used herein the term "waveguide" generally applies to conductive guides, such as a tubular metallic member, which can contain a liquid, solid or gaseous dielectric substance; in the plurality of all applications the waveguide is a hollow metallic tube, containing air. The term "feed" applies broadly to the primary active antenna component which cooperates with the main reflector or the subreflector; and this term is applicable to receiving, as well as transmitting systems. In transmission, the feed supplies or feeds the energy to the main reflector or to the subreflector, and in receiving it supplies or feeds the energy collected by the main reflector to the transceiver or other utilization device.

The invention will be more fully understood from the following detailed description in conjunction with the drawing in which:

FIG. 1 schematically illustrates a directional antenna in accordance with the instant invention comprising a paraboloidal main reflector having a waveguide feed, an open end of which is positioned at the focal point of the main reflector; and FIG. 2 schematically illustrates a directional antenna in accordance with the instant invention comprising a paraboloidal main reflector, a subreflector and a waveguide feed having a first open end thereof positioned on the axis of the main reflector.

Referring to FIG. 1, there is illustrated a directional antenna 10 comprising a conventional paraboloidal main reflector 1 of a design appropriate for the transmission and receiving of electromagnetic microwaves. The main reflector 1 is mountable on a support structure at the section thereof designated 2, such support structure being of a conventional design and not shown for simplification. A waveguide 3 comprising an elongated tubular member of elliptical cross-section extends between a transceiver device 9 to the segment 2 of the main reflector 1. Connected to the end of the waveguide 3 at such segment 2, and extending through a vertex aperture in the paraboloidal main reflector 1, is one end of a waveguide feed 4 having an elliptical cross-section throughout its axial length. The waveguide feed 4 is comprised of a transversely corrugated, longitudinally seam welded metallic tubular member which is rendered flexible by the corrugations so as to permit the waveguide feed 4 to be coiled in a manner to provide an open end 6 thereof at a focal point 5 of the main reflector 1, with the orientation of the open end 6 facing the main reflector 1. The open end 6 of the waveguide feed 4 is shown in the detailed drawing included in FIG. 1, to an enlarged scale so as to illustrate its elliptical configuration. Due to the elliptical cross-section and the flexibility of the corrugated waveguide feed 4, such waveguide feed may be readily bent and directly coupled to the waveguide 3 without the necessity of intermediate transition coupling elements. Preferably, the waveguide feed 4 and the waveguide 3 are constructed from longitudinally seam welded copper tubes which are transversely corrugated. Additionally, the flexible, corrugated copper tube of waveguide feed 4 has wrapped therearound reinforcing tapes comprised of glass fibers and casting resins to provide a degree of rigidity within the antenna assemblage.

As illustrated in FIG. 1, the end of the waveguide feed 4, including the open end 6 thereof positioned at the focal point 5, is maintained at such position by a conventional support mechanism schematically represented by guy wires 7. The cross-sectional dimensions of the open end 6 of the waveguide feed 4 are preferably determined in accordance with the design criteria of complete illumination of the main reflector 1. Such dimensional determinations are provided during the fabrication of extended lengths of corrugated tubular conductors employing the conventional, continuous tube forming steps of continuously forming a longitudinally moving strip of metallic material into a tubular configuration so as to place opposite edges into abutting relationship, continuously seam welding such opposite edges, continuously transversely corrugating the welded tubular member and subsequently passing the corrugated tubular member through shaping rollers to provide an internal elliptical cross-section which is equal in shape with the desired cross-sectional dimensions of the open end 6.

It is noted that an alternative to providing a discrete waveguide 3 serially connected to a waveguide feed 4, is the provision of a unitary corrugated tubular member having a continuous elliptical cross-section, and which functions as the full equivalent of such serially connected combination. Further, it will be apparent that the serially connected waveguide 3 and the waveguide feed 4 need not necessarily pass through the aperture in the main reflector 1 at section 2, but may be connected directly between the transceiver device 9 and the focal point 5 of the paraboloidal main reflector 1.

With reference to FIG. 2, there is illustrated a directional antenna which functions in accordance with the Cassegrain principle; more particularly, an antenna which differs from that illustrated in FIG. 1 in that it additionally employs a subreflector 8 positioned at the focal point of the paraboloidal main reflector 1, and that the elliptically configured open end 6 of the waveguide feed 4 is positioned on the axis of the main reflector 1 but facing the subreflector 8. The above noted descriptive statements concerning the directional antenna 10 of FIG. 1 as to the serial connections and configurations of the waveguide 3 and the waveguide feed 4, are also applicable with respect to the embodiment of the instant invention illustrated in FIG. 2.

With regard to the design of directional antennas schematically illustrated in both FIGS. 1 and 2, it has been found that the cross-sectional dimensions of the serially connected waveguide 3 and waveguide feed 4 may be larger than necessary (i.e., oversized) for fundamental mode application. In this case a more complete illumination of the main reflector 1 has been achieved. Further, such larger (oversized) dimensions have provided for a reduction in the transmission attenuation through the serially connected waveguides, because transmissions through such guides can be achieved by using overmoded waves.

Numerous modifications and variations of the present invention are possible in light of the above teachings, and therefore, within the scope of the appended claims, the invention may be practiced otherwise than as particularly described.

I claim:

1. In a directional antenna for microwave transmissions comprising a paraboloidal main reflector, a first waveguide comprising a waveguide feed having an elliptical cross-section and having a first end with an energizer thereat, said first end having an open end operatively irradiatingly directed relative to said main reflector, and a second waveguide serially communicatingly connected between a second end of said waveguide feed and a transceiver device, the improvement in cooperative combination therewith wherein:

said elliptical cross-section of said waveguide feed completely throughout said waveguide feed and at said first end is constant and is dimensioned such that said waveguide feed at said first end simultaneously alone itself forms said energizer forming an eliptical aperture at said open end having the same cross-section as said elliptical cross-section of said waveguide feed, the energizer constituting means for completely being in irradiation communication with the entire said main reflector with respect to frequencies being transmitted, said second waveguide is formed completely throughout with the exact same dimensions and elliptical cross-section of said waveguide feed, said waveguide feed and said second waveguide respectively comprises a transversely corrugated, longitudinally seam welded metallic tubular member, said waveguide feed further comprises reinforcing tapes wound about said metallic tubular member thereof, and said waveguide feed and said second waveguide have oversized cross-sectional dimensions with respect to the frequencies to be transmitted for an overmoded electromagnetic wave transmission.

2. The directional antenna as set forth in claim 1, wherein said first end faces said main reflector.

3. The directional antenna as set forth in claim 1, further comprising a subreflector positioned at the focal point of said paraboloidal main reflector, said open end of said waveguide feed faces said subreflector.

4. The directional antenna as set forth in claim 1, wherein said waveguide feed at said first end forms a straight continuous non-slitted tube having said elliptical cross-section.

5. The directional antenna as set forth in claim 1, wherein said transceiver device constitutes means for transmitting and receiving, respectively, only the frequencies of the overmoded electromagnetic wave transmission which is overmoded with respect to said oversized cross-sectional dimensions of said waveguide feed and said second waveguide.

* * * * *